US005560675A

United States Patent [19]

Altheimer et al.

[11] Patent Number: 5,560,675

[45] Date of Patent: Oct. 1, 1996

[54] FOLDING ROCKING CHAIR

[75] Inventors: Dana W. Altheimer, Port Washington; Douglas J. Carpiaux, Milwaukee, both of Wis.

[73] Assignee: Bemis Manufacturing Company, Sheboygan Falls, Wis.

[21] Appl. No.: 181,181

[22] Filed: Jan. 13, 1994

[51] Int. Cl.[6] ..... A47C 3/029

[52] U.S. Cl. ..... 297/33; 297/32; 297/258.1; 297/272.1

[58] Field of Search ..... 297/32, 33, 28, 297/47, 35, 258, 272, 272.1, 258.1, 261.1, 261.2, 271.5, 271.6

[56] References Cited

U.S. PATENT DOCUMENTS

| | | | |
|---|---|---|---|
| 147,589 | 2/1874 | Baer . | |
| 160,629 | 9/1874 | Wellman . | |
| 172,785 | 1/1876 | Selleg et al. . | |
| D. 179,335 | 11/1956 | Wright | D15/1 |
| 179,920 | 7/1876 | Holton . | |
| 179,949 | 7/1876 | Parker . | |
| 179,980 | 7/1876 | Wakefield . | |
| D. 198,625 | 7/1964 | Lockshin | D15/6 |
| D. 198,843 | 8/1964 | Lockshin | D15/1 |
| D. 234,240 | 2/1975 | Noda et al. | D6/1 |
| D. 234,414 | 3/1975 | Becquet | D6/1 |
| 244,841 | 7/1881 | Bangs . | |
| 248,312 | 10/1881 | Hayes | 297/32 |
| D. 250,257 | 11/1978 | Pfohl | D12/131 |
| 251,783 | 1/1882 | Johnson et al. . | |
| D. 274,770 | 7/1984 | Massonnet | D6/375 |
| D. 279,842 | 7/1985 | Walker | D6/370 |
| D. 281,933 | 12/1985 | Deconinck | D6/368 |
| D. 287,673 | 1/1987 | Verschuren | D6/379 |
| D. 300,189 | 3/1989 | Frinier | D6/379 |
| D. 303,591 | 9/1989 | Grosfillex | D6/370 |
| D. 303,736 | 10/1989 | Grosfillex | D6/379 |
| D. 313,515 | 10/1988 | Wood | D6/380 |
| D. 317,088 | 5/1991 | Grosfillex | D6/379 |
| D. 325,837 | 5/1992 | Schwartz | D6/500 |
| D. 326,584 | 6/1992 | van de Ven | D6/361 |
| D. 329,339 | 9/1992 | Grosfillex | D6/370 |
| D. 330,291 | 10/1992 | Grosfillex | D6/370 |
| D. 331,323 | 12/1992 | Grosfillex | D6/370 |
| D. 331,668 | 12/1992 | van de Ven | D6/368 |
| D. 334,294 | 3/1993 | Grosfillex | D6/367 |
| D. 334,299 | 3/1993 | Embree | D6/379 |
| D. 335,585 | 5/1993 | Grosfillex | D6/361 |
| D. 335,776 | 5/1993 | Lamalle | D6/368 |
| D. 335,972 | 6/1993 | Lamalle | D6/379 |
| D. 336,382 | 6/1993 | Hubert | D6/370 |
| 636,671 | 11/1899 | Kidd et al. | 297/33 X |
| 676,788 | 6/1901 | Wallis . | |
| 890,192 | 6/1908 | Stombaugh . | |
| 1,782,763 | 11/1930 | Overbey | 297/258 X |
| 2,110,338 | 3/1938 | Oermann | 155/75 |
| 2,507,165 | 5/1950 | Kreutzer | 155/73 |
| 2,699,814 | 1/1955 | Kahn | 155/2 |
| 2,715,937 | 8/1955 | Thomas | 155/76 |
| 2,788,056 | 4/1957 | Parker | 155/75 |
| 3,048,440 | 8/1962 | McPherson et al. | 297/33 |
| 3,083,051 | 10/1961 | Milbourne | 297/19 |
| 3,114,572 | 12/1963 | Hopkins | 297/33 |
| 3,269,771 | 8/1966 | Erdos | 297/132 |
| 3,671,072 | 6/1972 | Holt . | |

(List continued on next page.)

FOREIGN PATENT DOCUMENTS

| | | | |
|---|---|---|---|
| 169112 | 2/1951 | Austria | 297/28 |
| 2041306 | 10/1992 | Canada . | |
| 963088 | 6/1950 | France | 1/20 |

*Primary Examiner*—Peter R. Brown
*Assistant Examiner*—David E. Allred
*Attorney, Agent, or Firm*—Michael, Best & Friedrich

[57] ABSTRACT

A folding rocking chair including a seat pivotally connected to a backrest; a rocker assembly; a front leg assembly pivotally connected to the seat and the rocker assembly; a rear leg assembly pivotally connected to the front leg assembly; and, a pair of armrests pivotally connected to the backrest. The chair is folded such that the seat, the backrest, the front leg assembly, the rear leg assembly and the armrests are substantially parallel to the rocker assembly.

11 Claims, 3 Drawing Sheets

U.S. PATENT DOCUMENTS

| | | | |
|---|---|---|---|
| 4,285,543 | 8/1981 | Clark | 297/272 |
| 4,341,419 | 7/1982 | Sebel | 297/239 |
| 4,749,232 | 6/1988 | Guichon | 297/359 |
| 4,807,926 | 2/1989 | Brunn | 297/33 |
| 4,898,421 | 2/1990 | Brunn | 297/28 |
| 4,906,046 | 3/1990 | Kleinklaus | 297/359 |
| 5,044,691 | 9/1991 | Guichon | 297/239 |
| 5,088,792 | 2/1992 | Guichon | 297/445 |

FOLDING ROCKING CHAIR

BACKGROUND OF THE INVENTION

The invention relates to chairs, and more particularly to folding rocking chairs.

U.S. Pat. No. 4,807,926 discloses a folding rocking chair. When the chair is folded up, the backrest, seat, legs, armrests and sleds are all substantially parallel. When the chair is unfolded, the inclination of the seat is adjustable.

FIG. 1 illustrates a prior art folding non-rocking chair. The chair includes a seat, a backrest pivotally connected to the seat, and a front leg assembly including front legs pivotally connected to the seat. The chair also includes a rear leg assembly including rear legs. Projections on the seat slide in tracks in the inner surfaces of the rear legs. The upper ends of the front and rear legs on each side of the seat are pivotally connected. The chair also includes armrests pivotally connected to the backrest. The underside of each armrest has therein a plurality of notches which receive a projection on the upper end of a respective rear leg. The inclination of the backrest is adjustable by changing the notches in which the projections are received.

SUMMARY OF THE INVENTION

The invention provides a folding rocking chair which utilizes the seat and the backrest of the above-described prior art non-rocking chair. In addition to the seat and backrest, the folding rocking chair comprises a front leg assembly, a rear leg assembly, a pair of armrests, and a rocker assembly.

More particularly, the rocker assembly has a one-piece construction and includes a pair of rocking sleds connected by a generally horizontal sled cross-member. The upper surface of each sled has thereon a stop, and the inner surface of each sled has therein front and rear recesses. The rear recess is defined in part by an upwardly facing, concave ledge. The ledges preferably define portions of a cylinder centered on the axis about which the rear leg assembly pivots.

The front leg assembly has a one-piece construction and includes a pair of front legs connected by a front cross-member. Each front leg is connected to a side of the seat for pivotal movement relative thereto about a generally horizontal front axis and at a point intermediate the upper and lower ends of the front leg. The lower end of each front leg is received in the front recess of a respective sled and is connected to the sled for pivotal movement relative thereto about a generally horizontal sled axis. The front cross-member has an upper surface defining a pair of ramp surfaces, each ramp surface being located adjacent the lower end of a respective front leg. When the chair is unfolded, the upper surfaces of the sleds engage the front legs to limit the forward pivotal movement of the front legs, and the ramp surfaces on the front cross-member are located at the front ends of the ledges on the sleds and form extensions of the ledges.

The rear leg assembly has a one-piece construction and includes a pair of rear legs connected by a rear cross-member. The inner surface of each rear leg defines a guide track slidably receiving a projection on a respective side of the seat. The upper ends of the rear legs are connected to the upper ends of the front legs for pivotal movement relative thereto about a generally horizontal leg axis, and the upper ends of the rear legs have thereon respective leg projections.

When the chair is unfolded, the lower ends of the rear legs are located adjacent the rear ends of the sled ledges and are supported solely by the upper surfaces of the sleds, the stops on the upper surfaces of the sleds limit rearward movement of the rear legs relative to the sleds, and the rear cross-member is supported by the sled cross-member. A selectively releasable locking mechanism locks the rear cross-member to the sled cross-member.

The rear ends of the armrests are connected to the backrest for pivotal movement relative thereto about a generally horizontal armrest axis, and the underside of each armrest has therein a plurality of notches which can receive the leg projections on the upper ends of the rear legs. When the chair is unfolded, the inclination of the backrest is adjusted by changing the notches in which the leg projections are received.

As the chair is folded, the seat projections move along the guide tracks in the rear legs, the rear recesses in the sleds provide clearance for the rear cross-member as the rear leg assembly pivots about the leg axis, and the lower ends of the rear legs slide forwardly along the upper surfaces of the sleds until the lower surface of the rear cross-member moves onto the ramp surfaces of the front cross-member and the rear legs are substantially parallel to and in abutment with the front legs. Thereafter, the front and rear leg assemblies pivot together about the front axis and relative to the sleds so that the upper ends of front and rear legs move toward the rear ends of the sleds. When the chair is completely folded, the front and rear legs, the backrest, the seat and the armrest are substantially parallel to the sleds.

Although the preferred embodiment of the invention has the front legs pivotally connected to the sleds, it should be understood that the rear legs could be pivotally connected to the sleds, with the front leg assembly moving translationally relative to the sleds.

One advantage of the invention is that identical seats and identical backrests can be used to manufacture both rocking and non-rocking chairs. This significantly reduces the expense normally incurred when manufacturing both types of chairs. When manufacturing a non-rocking chair, a seat and a backrest are connected, non-rocking front and rear leg assemblies are connected to the seat and to each other, armrests are connected to the leg assemblies and to the backrest, and the assembled non-rocking chair is folded for shipping. When manufacturing a rocking chair, a seat and a backrest are connected, rocking front and rear leg assemblies are connected to the seat and to each other, armrests are connected to the backrest and to the leg assemblies, and a sled assembly is connected to the front leg assembly. The assembled chair is then folded for shipping.

Other features and advantages of the invention will become apparent to those skilled in the art upon review of the following detailed description, claims and drawings.

Figure 1:
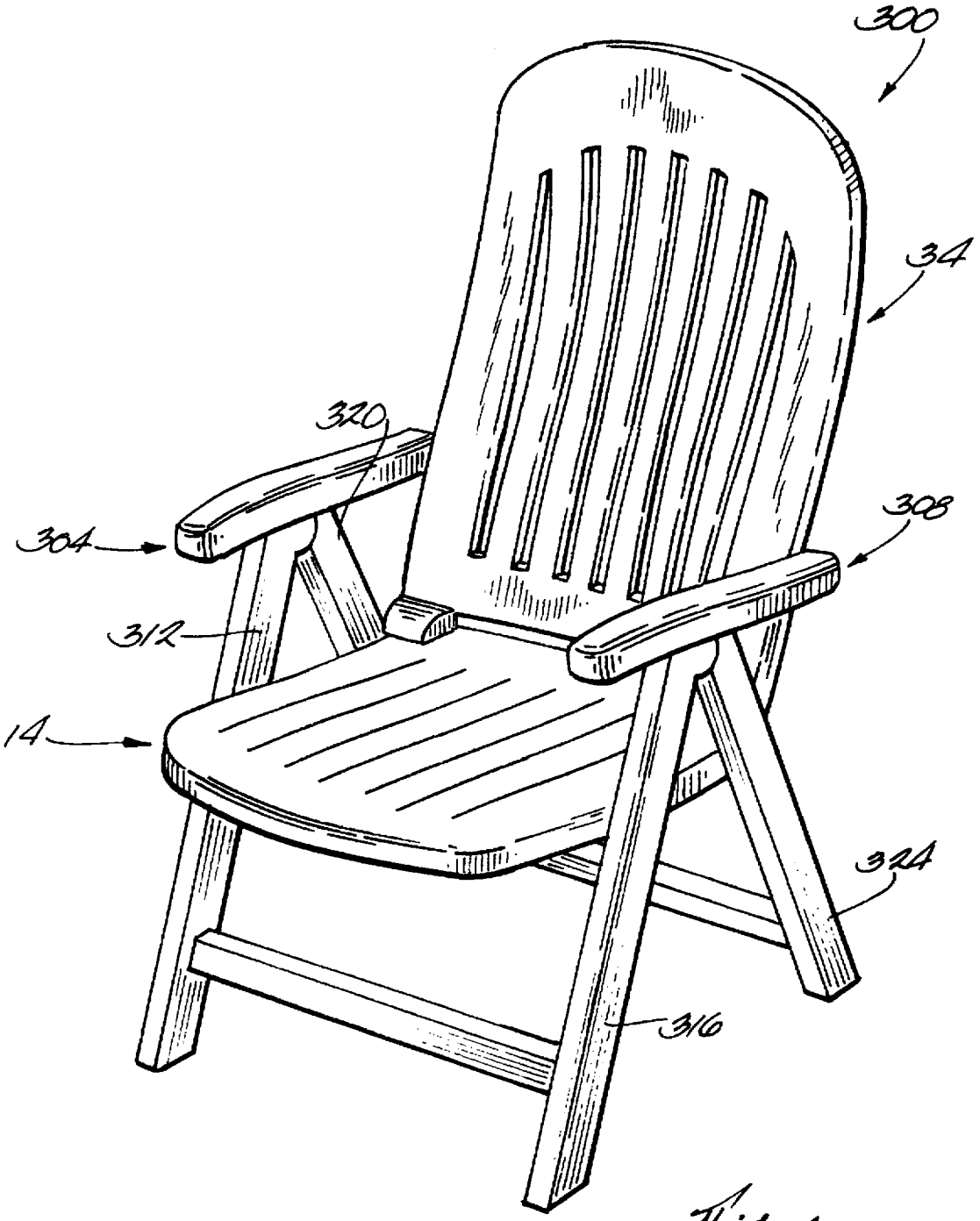
Fig. 1 PRIOR ART
FIG. 1 is a perspective view of a prior art non-rocking folding chair.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A folding rocking chair 10 embodying the invention is illustrated in FIGS. 2–6. The chair 10 comprises (FIG. 2) a seat 14 having opposite first and second or left and right sides 18 and 22 and a rear end 26. Each side 18 or 22 of the seat 14 has thereon a seat projection 30 adjacent the rear end 26. The projection 30 on the left side 18 of the seat 14 is not shown in FIG. 2.

The chair 10 also comprises a backrest 34 having opposite first and second or left and right sides 38 and 42 and a lower end 46. The lower end 46 of the backrest 34 is connected to the rear end 26 of the seat 14 for pivotal movement relative thereto about a generally horizontal backrest axis 48. Any suitable pivotal connection can be employed.

The chair 10 further comprises a rocker assembly 50. The rocker assembly 50 includes first and second or left and right rocking sleds 54 and 58. The sleds 54 and 58 are mirror images of each other, and only the left sled 54 will be described in detail. The sled 54 has (see FIG. 2) front and rear ends 62 and 66, an upper surface 70, and an inner surface 74. The upper surface 70 has thereon a rear stop 78. The inner surface 74 has therein a rear recess 82 defined in part by an upwardly facing, concave ledge 86 having front and rear ends 90 and 94. The inner surface 74 also has therein a front recess 100 defined in part by an upwardly facing, concave ledge 104 and by a sidewall 108. The sidewall 108 has therein a bore 112. The rocker assembly 50 also includes a generally horizontal sled cross-member 116 extending between the left and right sleds 54 and 58 adjacent the rear ends 66 thereof. The sled cross-member 116 has an upper surface 120.

Figure 2:
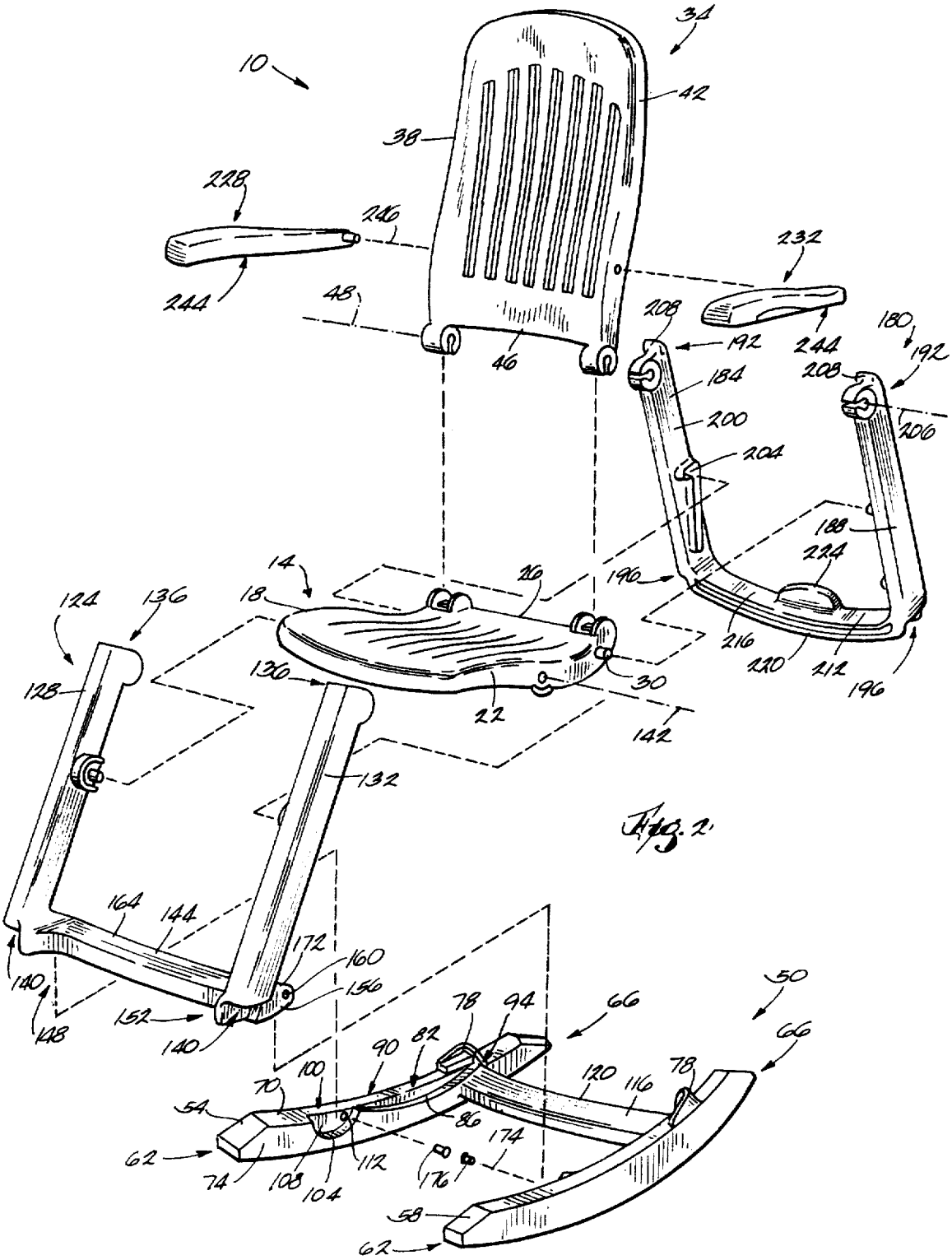
FIG. 2 is an exploded perspective view of a folding rocking chair embodying the invention.
Figures 3, 4, 5, 6, 7:
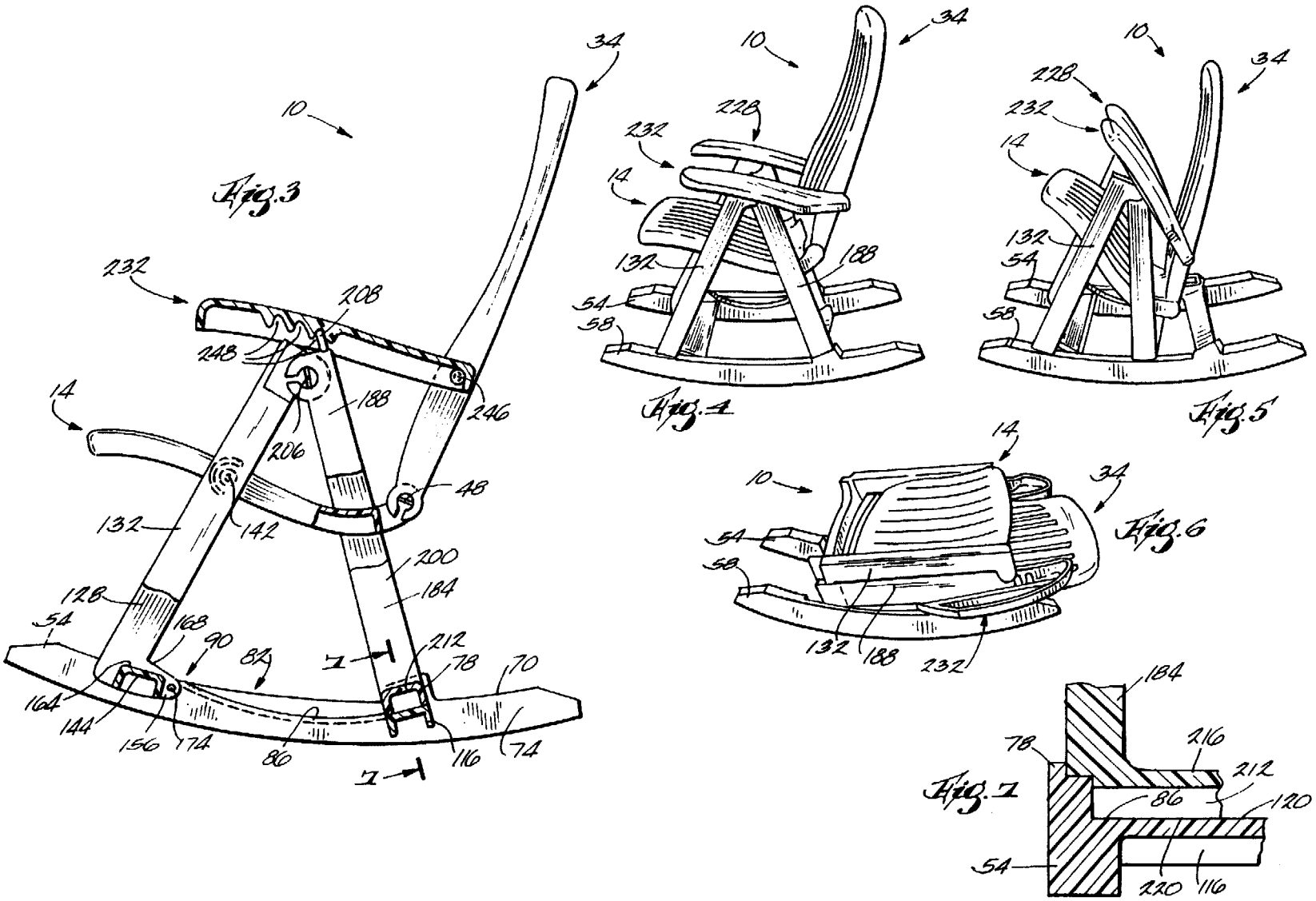
FIG. 3 is a side elevational view partially broken away, of the chair shown in FIG. 2.
FIG. 4 is a perspective view of the chair shown in FIG. 2 in its unfolded position.
FIG. 5 is a view similar to FIG. 4 showing the chair moving from its unfolded position to its folded position.
FIG. 6 is a view similar to FIG. 5 showing the chair in its folded position.
FIG. 7 is a view taken along line 7—7 in FIG. 3.

The chair 10 also comprises (see FIG. 2) a front leg assembly 124. The front leg assembly 124 includes first and second or left and right front legs 128 and 132 having respective upper and lower ends 136 and 140. The front legs 128 and 132 are respectively connected to the left and right sides 18 and 22 of the seat 14 for pivotal movement relative thereto about a generally horizontal front axis 142. The legs 128 and 132 are connected to the sides 18 and 22 of the seat 14 at a point intermediate the upper and lower ends 136 and 140 of the legs 128 and 132. Any suitable pivotal connection can be employed. The front leg assembly 124 also includes a generally horizontal front cross-member 144 extending between the lower ends 140 of the legs 128 and 132 and having opposite first and second or left and right ends 148 and 152. Each end 148 and 152 has thereon a rearwardly extending projection 156 (FIGS. 2 and 3) having therein a bore 160. The projection 156 on the left end 148 is not shown in FIG. 2 but is shown in FIG. 3. The front cross-member 144 also has (see FIGS. 2 and 3) an upper surface 164 defining first and second or left and right ramp surfaces 168 and 172 respectively located adjacent the lower ends of the front legs 128 and 132. The left and right ends 148 and 152 of the front cross-member 144 are respectively received in the front recesses 100 of the sleds 54 and 58 and are respectively connected to the rocking sleds 54 and 58 for pivotal movement relative thereto about a generally horizontal sled axis 174. As best shown in FIG. 2, the front cross-member 144 is connected to the rocking sleds 54 and 58 by pins 176 inserted through the bores 160 in the left and right ends 148 and 152 of the front cross-member 144 and into the bores 112 in the sidewalls 108 of the front recesses 100. Thus the lower ends 140 of the left and right front legs 128 and 132 are pivotally connected to the sleds 54 and 58 respectively.

The chair 10 further comprises (see FIG. 2) a rear leg assembly 180. The rear leg assembly 180 includes first and second or left and right rear legs 184 and 188. The legs 184 and 188 are mirror images of each other, and only the left rear leg 184 will be described. The rear leg 184 has an upper end 192, a lower end 196 and an inner surface 200. The inner surface 200 defines a guide track 204. The guide track 204 of the rear leg 184 respectively slidably receives the left seat projection 30. The upper end 192 of the rear leg 184 is connected to the upper end 136 of the front leg 128 for pivotal movement relative thereto about a generally horizontal leg axis 206. Any suitable pivotal connection can be employed. The rear recess ledges 86 define portions of a cylinder centered on the leg axis 206. The upper end 192 of the rear leg 184 (FIGS. 2 and 3) has thereon a leg projection 208. The rear leg assembly 180 also includes a generally horizontal rear cross-member 212 extending between the lower ends 196 of the rear legs 184 and 188. The rear cross-member 212 has (see FIGS. 2 and 7) an upper surface 216 and a lower surface 220. The upper surface 216 has thereon (see FIG. 2) a projection 224 to facilitate movement of the rear leg assembly 180 by hand or by foot.

The chair 10 also comprises first and second or left and right armrests 228 and 232 having respective front and rear ends and undersides 244. The armrests 228 and 232 are mirror images of each other, and only the right armrest 232 will be described. The rear end of the armrest 232 is connected to the right side 42 of the backrest 34 for pivotal movement relative thereto about a generally horizontal armrest axis 246. Any suitable pivotal connection can be employed. The underside 244 of the armrest 232 has therein (see FIG. 3) three notches 248.

As best seen in FIGS. 4–6, the chair 10 is movable between a folded position (FIG. 6) and an unfolded position (FIGS. 3 and 4). When the chair 10 is in the unfolded position the backrest 34 extends transversely to the seat 14, the front and rear legs 128, 132, 184 and 188 extend transversely to the sleds 54 and 58, and the armrests 228 and 232 extend transversely to the backrest 34. The chair 10 includes a mechanism (not shown) for locking the chair in the unfolded position. The locking mechanism includes selectively releasable means for locking the rear cross-member 212 to the sled cross-member 116 when the chair 10 is in the unfolded position.

In the unfolded position (FIGS. 3 and 4) the upper surfaces 70 of the sleds 54 and 58 respectively engage the lower ends 140 of the front legs 128 and 132 forwardly of the front recesses 100 to limit counter-clockwise pivotal movement of the front legs 128 and 132. Thus the upper surfaces 70 of the sleds 54 and 58 act as stop surfaces. The ramp surfaces 168 and 172 (the ramp surface 168 is shown in FIG. 3) are respectively located at the front ends 90 of the rear recess ledges 86 and form extensions of the rear recess ledges 86. The leg projections 208 extend into notches 248 in the undersides 244 of the armrests 228 and 232 allowing for adjustable movement of the backrest 34. The lower ends 196 of the rear legs 184 and 188 are respectively located adjacent the rear ends 94 of the rear recess ledges 86 and are respectively supported solely by the upper surfaces 70 of the left and right sleds 54 and 58. The rear stops 78 (FIGS. 2 and 3) limit rearward movement of the rear legs 184 and 188 relative to the sleds 54 and 58. As shown in FIG. 7, the lower surface 220 of the rear cross-member 212 is supported by the upper surface 120 of the sled cross-member 116.

When the chair 10 moves from the unfolded to the folded position as shown in FIG. 5, the rear legs 184 and 188 pivot clockwise relative to the front legs 128 and 132 until the rear legs 184 and 188 are substantially parallel to and in abutment with the front legs 128 and 132 as shown in FIG. 6. During this movement, the rear recesses 82 of the sleds 54 and 58 provide clearance for the rear cross-member 212, and the lower ends 196 of the rear legs 184 and 188 slide forwardly along the upper surfaces 70 of the sleds 54 and 58 until the lower surface 220 of the rear cross-member 212 moves onto the ramp surfaces 168 and 172. Also, the seat projections 30 move downwardly in the tracks 204, the seat 14 pivots clockwise (about the front axis 142) relative to the front legs 128 and 132, and the armrests 228 and 232 pivot (about the armrest axis 246) clockwise relative to the backrest 34. Next, the front and rear leg assemblies 124 and 180, the seat 14, the armrests 228 and 232 and the backrest 34 pivot together about the sled axis 174 so that the upper ends of the front and rear legs 128, 132, 184, and 188 move toward the rear ends 66 of the sleds 54 and 58 until the front and rear legs 128, 132, 184, and 188 are substantially parallel to the sleds 54 and 58 as shown in FIG. 6. When the chair 10 is in the folded position the backrest 34, the seat 14, and the armrests 228 and 232 are also substantially parallel to the sleds 54 and 58. The chair 10 is preferably folded for shipping.

While the illustrated chair 10 has a front leg assembly 124 pivotally connected to the sleds 54 and 58 and a rear leg assembly 180 movable along the sleds 54 and 58, it should be understood that the chair 10 could have the opposite construction such that the rear leg assembly 180 is pivotally connected to the sleds 54 and 58 and the front leg assembly 124 is movable along the sleds 54 and 58.

A folding non-rocking chair 300 (FIG. 1) can be made using the identical seat 14 and backrest 34 of the folding rocking chair 10 shown in FIGS. 2–7. The non-rocking chair 300 also comprises first and second or left and right armrests 304 and 308, first and second or left and right non-rocking front legs 312 and 316, and first and second or left and right non-rocking rear legs 320 and 324 shown in FIG. 1. To make the non-rocking chair 300, the lower end 46 of the backrest 34 is connected to the rear end 26 of the seat 14. The left and right non-rocking front legs 312 and 316 are respectively connected to the left and right sides 18 and 22 of the seat 14. The left and right non-rocking rear legs 320 and 324 are respectively connected to the left and right sides 18 and 22 of the seat 14 and to the upper ends of the left and right front legs 312 and 316. The armrests 304 and 308 are respectively connected to the left and right sides of the backrest 34 and to the upper ends of the legs 320 and 324. The folding non-rocking chair 300 can be folded for shipping such that the backrest 34, the seat 14, the armrests 304 and 308, the non-rocking front legs 312 and 316, and the non-rocking rear legs 320 and 324 are substantially parallel.

Various features of the invention are set forth in the following claims.

I claim:

1. A folding rocking chair moveable between folded and unfolded positions, said chair comprising a seat having opposite first and second sides and a rear end, a backrest having opposite first and second sides and a lower end, said lower end of said backrest being connected to said rear end of said seat for pivotal movement relative thereto about a generally horizontal backrest axis, a rocker assembly including first and second rocking sleds each having respective front and rear ends and respective outer and inner surfaces, said inner surfaces facing one another, said inner surfaces being notched to define therein respective opposed upwardly open recesses each defined by an upwardly facing, ledge and a single vertical sidewall extending from front to rear, a front leg assembly including first and second front legs having respective upper and lower ends, said first and second front legs being respectively connected to said first and second sides of said seat for movement relative thereto, and a rear leg assembly including first and second rear legs having respective upper and lower ends, said first and second rear legs being respectively connected to said first and second sides of one of said seat and said backrest for movement relative thereto, said lower ends of said first and second legs of one of said leg assemblies being respectively connected to said first and second sleds for movement relative thereto, the other of said leg assemblies also including a generally horizontal cross-member extending between and below said lower ends of said first and second legs of said other of said assemblies, said chair being moveable between said folded and unfolded positions such that, when said chair is in said unfolded position, said backrest extends transversely to said seat, and said front and rear legs extend transversely to said sleds, and such that, when said chair moves from said unfolded position to said folded position, said cross-member extends into said recesses and moves along the length of said recesses, and wherein said recesses provide clearance for said cross-member.

2. A chair as set forth in claim 1 wherein said ledges are concave.

3. A chair as set forth in claim 2 wherein said first front leg is connected to said first side of said seat for pivotal movement relative thereto about a generally horizontal front axis and at a point intermediate said upper and lower ends of said first front leg, said second front leg is connected to said second side of said seat for pivotal movement relative thereto about said front axis and at a point intermediate said upper and lower ends of said second front leg, and said lower ends of said first and second front legs are respectively connected to said first and second sleds for pivotal movement relative thereto about a generally horizontal sled axis, wherein said upper ends of said first and second rear legs are respectively connected to said upper ends of said first and second front legs for pivotal movement relative thereto about a generally horizontal leg axis, and wherein said ledges define portions of a cylinder centered on said leg axis.

4. A folding rocking chair moveable between folded and unfolded positions, said chair comprising a seat having opposite first and second sides and a rear end, a backrest having opposite first and second sides and a lower end, said lower end of said backrest being connected to said rear end of said seat for pivotal movement relative thereto about a generally horizontal backrest axis, a rocker assembly including first and second rocking sleds having respective front and rear ends and respective stop surfaces, a front leg assembly including first and second front legs having respective upper and lower ends, said first and second front legs being respectively connected to said first and second sides of said seat for movement relative thereto, and a rear leg assembly including first and second rear legs having respective upper and lower ends, said first and second rear legs being respectively connected to said first and second sides of one of said seat and said backrest for movement relative thereto, said lower ends of said first and second legs of one of said leg assemblies being respectively fixedly and pivotally connected to said first and second sleds for pivotal non sliding movement relative thereto about a generally horizontal sled axis, said chair being moveable between said folded and unfolded positions such that, when said chair is in said unfolded position, said backrest extends transversely to said seat, said front and rear legs extend transversely to said sleds, and said first and second stop surfaces respectively engage said first and second legs of said one of said assemblies to limit pivotal movement thereof.

5. A chair as set forth in claim 4 wherein said first front leg is connected to said first side of said seat for pivotal movement relative thereto about a generally horizontal front axis and at a point intermediate said upper and lower ends of said first front leg, said second front leg is connected to said second side of said seat for pivotal movement relative thereto about said front axis and at a point intermediate said upper and lower ends of said second front leg, and said lower ends of said first and second front legs are respectively connected to said first and second sleds for pivotal movement relative thereto about said sled axis, and wherein said upper ends of said first and second rear legs are respectively connected to said upper ends of said first and second front legs for pivotal movement relative thereto about a generally horizontal leg axis.

6. A chair as set forth in claim 5 wherein said first and second sleds have therein respective first and second recesses, and wherein said lower ends of said first and second front legs are respectively received in said first and second recesses.

7. A chair as set forth in claim 4 wherein said sleds have respective upper surface, and wherein said stop surfaces are portions of said upper surfaces of said sleds.

8. A folding rocking chair moveable between folded and unfolded positions, said chair comprising a seat having opposite first and second sides and a rear end, a backrest having opposite first and second sides and a lower end, said lower end of said backrest being connected to said rear end of said seat for pivotal movement relative thereto about a generally horizontal backrest axis, a rocker assembly including first and second rocking sleds having respective front and rear ends and respective inner surfaces, said inner surfaces defining respective upwardly facing ledges having respective front and rear ends, a front leg assembly including first and second front legs having respective upper and lower ends, said first and second front legs being respectively connected to said first and second sides of said seat for movement relative thereto, and said front leg assembly also including a generally horizontal front cross-member extending between said lower ends of said first and second front legs, and a rear leg assembly including first and second rear legs having respective upper and lower ends, said first and second rear legs being respectively connected to said first and second sides of one of said seat and said backrest for movement relative thereto, and said rear leg assembly also including a generally horizontal rear cross-member extending between said lower ends of said rear legs, said lower ends of said first and second legs of one of said leg assemblies being respectively connected to said first and second sleds for movement relative thereto, said cross-member of said one of said leg assemblies having an upper surface defining first and second ramp surfaces, said cross-member of the other of said leg assemblies having a lower surface, said chair being moveable between said folded and unfolded positions such that, when said chair moves from said unfolded position to said folded position, said lower surface moves onto said ramp surfaces.

9. A chair as set forth in claim 8 wherein said first front leg is connected to said first side of said seat for pivotal movement relative thereto about a generally horizontal front axis and at a point intermediate said upper and lower ends of said first front leg, said second front leg is connected to said second side of said seat for pivotal movement relative thereto about said front axis and at a point intermediate said upper and lower ends of said second front leg, and said lower ends of said first and second front legs are respectively connected to said first and second sleds for pivotal movement relative thereto about a generally horizontal sled axis, wherein said upper ends of said first and second rear legs are respectively connected to said upper ends of said first and second front legs for pivotal movement relative thereto about a generally horizontal leg axis, and wherein said one leg assembly is said front leg assembly and said other leg assembly is said rear leg assembly.

10. A folding rocking chair moveable between folded and unfolded positions, said chair comprising a seat having opposite first and second sides and a rear end, said first and second sides having thereon respective first and second seat projections adjacent said rear end, a backrest having opposite first and second sides and a lower end, said lower end of said backrest being connected to said rear end of said seat for pivotal movement relative thereto about a generally horizontal backrest axis, a rocker assembly including first and second rocking sleds having respective front and rear ends, respective upper surfaces and respective inner surfaces, said upper surfaces having thereon respective stops, said inner surfaces having therein respective rear recesses defined in part by respective upwardly facing, concave ledges having respective front and rear ends, and said inner surfaces of said first and second sleds having therein respective first and second front recesses, and said rocker assembly also including a generally horizontal sled cross-member extending between said first and second sleds adjacent said rear ends thereof, a front leg assembly including first and second front legs having respective upper and lower ends, said first front leg being connected to said first side of said seat for pivotal movement relative thereto about a generally horizontal front axis and at a point intermediate said upper and lower ends of said first front leg, said second front leg being connected to said second side of said seat for pivotal movement relative thereto about said front axis and at a point intermediate said upper and lower ends of said second front leg, and said front leg assembly also including a generally horizontal front cross-member having opposite first and second ends and extending between said lower ends of said first and second front legs, said front cross-member having an upper surface defining first and second ramp surfaces respectively located adjacent said lower ends of said first and second front legs, said first and second ends of said front cross-member being respectively received in said first and second front recesses and respectively connected to said first and second sleds for pivotal movement relative thereto about a generally horizontal sled axis, a rear leg assembly including first and second rear legs having respective upper and lower ends and having respective inner surfaces defining respective guide tracks, said first and second guide tracks respectively slidably receiving said first and second seat projections, said upper ends of said first and second rear legs being respectively connected to said upper ends of said first and second front legs for pivotal movement relative thereto about a generally horizontal leg axis, said upper ends of said first and second rear legs having thereon respective first and second leg projections, and said rear leg assembly also including a generally horizontal rear cross-member extending between said lower ends of said rear legs and having a lower surface, and first and second armrests having respective front and rear ends and respective undersides, said rear ends of said first and second armrests being respectively connected to said first and second sides of said backrest for pivotal movement relative thereto about a generally horizontal armrest axis, and each of said undersides having therein a plurality of notches, said chair being moveable between said folded and unfolded positions such that, when said chair is in said unfolded position, said backrest extends transversely to said seat, said front and rear legs extend transversely to said sleds, said armrests extend transversely to said backrest, said upper surfaces of said first and second sleds respectively engage said first and second front legs to limit pivotal movement of said front legs, said first and second ramp surfaces are respectively located at said front ends of said first and second ledges and form extensions of said ledges, said first and second leg projections extend into notches in said undersides of said first and second armrests, respectively, said lower ends of said first and second rear legs are respectively located adjacent said rear ends of said first and second ledges and supported solely by said upper surfaces of said first and second sleds, said stops limit rearward movement of said rear legs relative to said sleds, and said lower surface of said rear cross-member is supported by said sled cross-member, such that, when said chair moves from said unfolded position to said folded position, said seat projections move along said guide tracks, said rear recesses provide clearance for said rear cross-member, and said lower ends of rear legs slide forwardly along said upper surfaces of said sleds until said lower surface of said rear cross-member moves onto said ramp surfaces and said rear legs are substantially parallel to and in abutment with said front legs, after which said front and rear leg assemblies pivot together about said front axis so that said upper ends of said front and rear legs move toward said rear ends of said sleds until said front and rear legs are substantially parallel to said sleds, and such that, when said chair is in said folded position, said backrest, said seat and said armrests are also substantially parallel to said sleds.

11. A chair as set forth in claim 10 wherein said ledges define portions of a cylinder centered on said leg axis.

* * * * *

UNITED STATES PATENT AND TRADEMARK OFFICE

CERTIFICATE OF CORRECTION

PATENT NO. : 5,560,675

DATED : October 1, 1996

INVENTOR(S) : Dana W. Altheimer et al.

It is certified that error appears in the above—identified patent and that said Letters Patent is hereby corrected as shown below:

Column 7, line 53, delete "surface", insert -- surfaces --.

Signed and Sealed this

Tenth Day of December, 1996

*Attest:*

*Attesting Officer*

BRUCE LEHMAN

*Commissioner of Patents and Trademarks*